US011306371B1

(12) United States Patent
Sims et al.

(10) Patent No.: US 11,306,371 B1
(45) Date of Patent: Apr. 19, 2022

(54) GAS QUENCHING SYSTEM AND METHOD FOR MINIMIZING DISTORTION OF HEAT TREATED PARTS

(71) Applicant: DANTE Solutions, Inc., Cleveland, OH (US)

(72) Inventors: Justin Sims, North Ridgeville, OH (US); Blake Lynn Ferguson, Broadview Heights, OH (US); Zhichao Li, Middleburg Heights, OH (US)

(73) Assignee: DANTE Solutions, Inc., Cleveland, OH (US)

( * ) Notice: Subject to any disclaimer, the term of this patent is extended or adjusted under 35 U.S.C. 154(b) by 743 days.

(21) Appl. No.: 16/159,811

(22) Filed: Oct. 15, 2018

Related U.S. Application Data

(60) Provisional application No. 62/573,126, filed on Oct. 16, 2017.

(51) Int. Cl.
*C21D 11/00* (2006.01)
*C21D 1/613* (2006.01)

(52) U.S. Cl.
CPC ..... *C21D 11/005* (2013.01); *C21D 1/613* (2013.01); *C21D 2211/001* (2013.01); *C21D 2211/008* (2013.01)

(58) Field of Classification Search
CPC ..... C21D 11/005; C21D 1/613; C21D 2211/001; C21D 2211/008
See application file for complete search history.

(56) References Cited

U.S. PATENT DOCUMENTS

2017/0286579 A1* 10/2017 Shen ..... G06F 30/23

FOREIGN PATENT DOCUMENTS

CN 204918679 U * 12/2015
EP 0538575 A1 * 4/1993 ..... C21D 11/005
JP 2006342368 A * 12/2006

OTHER PUBLICATIONS

Zhichao (Charlie) Li, Heat Treatment Response of Steel Fatigue Sample During Vacuum Carburization and High Pressure Gas Quenching Process, Jun. 8, 2015, AMSE (Year: 2015).*

* cited by examiner

*Primary Examiner* — Anthony M Liang
(74) *Attorney, Agent, or Firm* — Edwin A. Sisson, Attorney at Law, LLC; Jeffrey J. Banyas; Edwin A. Sisson

(57) ABSTRACT

Described herein is a method for quenching a hot metal part. The method may comprise selecting a first node located at about a slowest cooling point of the metal part and a second node located at about a fastest cooling portion of the metal part. The method may also comprise quenching the metal part to a finish temperature with the requirement that there is a temperature difference of between about 5° C. and about 30° C. during a quench cycle. The quench cycle may start from a first time when the second node is about 5° C. above a martensite start temperature of the specific metal or metal alloy of the metal part, and end at a second time when the first node is at a temperature which is about or below a martensite finish temperature of the specific metal or metal alloy.

11 Claims, 14 Drawing Sheets

GAS QUENCHING SYSTEM AND METHOD FOR MINIMIZING DISTORTION OF HEAT TREATED PARTS

CROSS REFERENCES AND PRIORITIES

This Application claims priority to U.S. Provisional Application No. 62/573,126 filed on 16 Oct. 2017, the teachings of which are incorporated herein by reference in their entirety.

GOVERNMENT LICENSE STATEMENT

This invention was made with government support under Contract Number W911W6-16-D-0004 awarded by Army Contracting Command (ACC). The government has certain rights in this invention.

BACKGROUND

The use of quenching processes in the steel and metal heat treating industry is well-known. Typical processes involve removing a hot steel or metal part from a heating apparatus and immediately exposing said part to a cooling fluid known as a quenchant. Quenchants can come in liquid or gas form. Common liquid quenchants include water, various oils, liquid salt baths, and solutions of polymeric materials in water. Common gas quenchants include air, nitrogen, and other gasses or gas mixtures.

Traditional quenching operations, such as those described in United States Patent Publication No. 2006/0157169 (the "'169 Publication") are founded on the principle that the quenching should occur quickly. According to the known processes, and described in the '169 Publication, rapidly quenching a hot metal part allows the metal to transform from an austenite phase to a highly hardened martensite phase without forming other, softer metal phases such as perlite [sic] or bainite.

Traditional quenching operations such as those disclosed in the '169 Publication have long suffered from distortion issues. The nonuniform phase changes involved with cooling a hot metal part can result in the part warping or bending, which then requires post-treatment machining to bring the part back into its desired shape. In more extreme cases, the part can develop cracks and/or microfractures during cooling which can result in serious failures when the part is in use. In the most extreme cases, distortion can become so great during quenching that no post-treatment machining or straightening can be used to restore the part.

The need exists, therefore, for an improved quenching method which efficiently converts metal from an austenite phase to a martensite phase with minimal or no ferrite, pearlite or bainite formation, while reducing distortion.

SUMMARY

A method of quenching a hot metal part is disclosed. The metal party may be composed of a specific metal or metal alloy. The specific metal or metal alloy may be capable of having an austenite phase, a martensite phase, and inherent metal properties.

The method may comprise selecting a first node corresponding to about a slowest cooling portion of the hot metal part and a second node corresponding to about a fastest cooling portion of the hot metal part. The method may further comprising quenching the hot metal part to about 25° C. with the requirement that a temperature difference exists between the first node and the second node. The temperature difference may be between about 5° C. and about 30° C. during a quench cycle. The quench cycle may start from a first time when the second node is about 5° C. above a martensite start temperature of the specific metal or metal alloy. The quench cycle may end at a second time when the first node is at a temperature which is about a martensite finish temperature of the specific metal or metal alloy.

In some embodiments, the step of quenching the hot metal part may comprise exposing the hot metal part to a plurality of quench cycles. In such embodiments, each quench cycle may comprise introducing a first amount of a quenchant at a first quenchant temperature for a first quench time into a quench chamber containing the hot metal part, and subsequently introducing at least a second amount of the quenchant at a second quenchant temperature below the first quenchant temperature for a second quench time into the quench chamber.

In some embodiments, the first amount of a quenchant and the at least a second amount of a quenchant may each independently be of a type of quenchant selected from the group consisting of air, steam, water mist, and nitrogen. In some embodiments, the first amount of a quenchant and the at least a second amount of a quenchant are each of the same type of quenchant. In some embodiments, the first amount of a quenchant and the at least a second amount of a quenchant are each nitrogen.

The method may be conducted according to a quenching schedule. In some embodiments, the quenching schedule may be obtained by the following steps. The first step may be determining a CAD geometry of the hot metal part. The second step may be creating a finite element mesh from the CAD geometry. The third step may be selecting a quench unit having a known heat transfer coefficient. The fourth step may be obtaining a generic cooling schedule for the hot metal part wherein the generic cooling schedule may comprise at least a first temperature maintained for a first cooling time and at least a second temperature maintained for a second cooling time. The fifth step may be executing a first finite element analysis using the generic cooling schedule, the known heat transfer coefficient, and the inherent metal properties to identify the first node on the finite element mesh which has about a hottest temperature and the second node on the finite element mesh which has about a coldest temperature. The sixth step may be determining the quenching schedule by iteratively modifying the generic cooling schedule by conducting at least a second finite element analysis so that a temperature difference between the first node and the second node is between about 5° C. and about 30° C. during a solid phase transformation of the first node and the second node from the austenite phase to the martensite phase.

In some such embodiments, the CAD geometry may be selected from the group consisting of a three dimensional CAD geometry, a two-dimensional CAD geometry, or a one dimensional CAD geometry.

In some such embodiments, the second temperature may be less than the first temperature.

In some embodiments, the quenching schedule may further comprise a plurality of subsequent cooling temperatures wherein each subsequent cooling temperature may be maintained for a subsequent cooling time. In some such embodiments, each subsequent cooling temperature may be less than its previous cooling temperature.

In some embodiments, the method may be conducted according to an empirically determined quenching schedule. The empirically determined quenching schedule may be determined by placing a first temperature measurement device at the first node and a second temperature measurement device at the second node, and iteratively exposing the hot metal part to a quenchant at various temperatures and times so as to characterize the temperature difference during the quench cycle.

In some embodiments, the method may be conducted according to a quenching schedule determined in real time during the quenching step. The real time determined quenching schedule may be determined by measuring a temperature of the first node using a first temperature measurement device and a second temperature of the second node using a second temperature measurement device while the hot metal part is exposed to a quenchant at a quenchant temperature, and adjusting the quenchant temperature to maintain the temperature difference during the quench cycle.

DETAILED DESCRIPTION

Figure 1B:
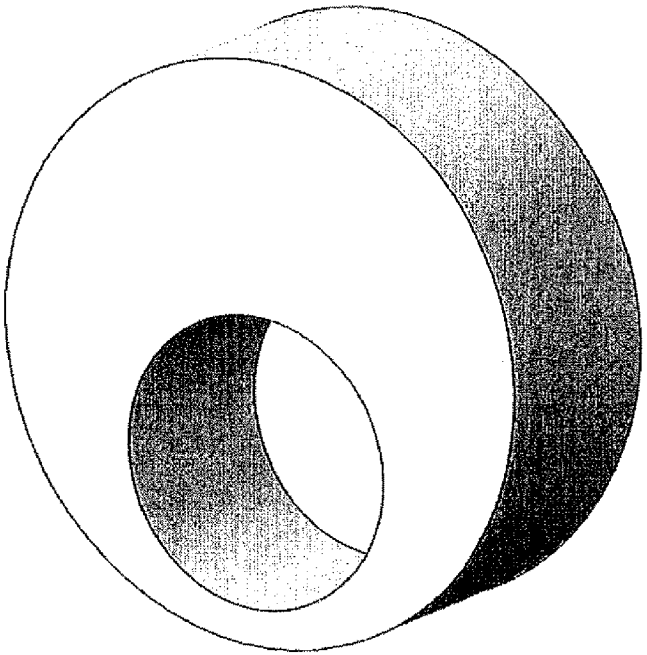
FIG. 1B is a depiction of a CAD geometry of the example part shown in FIG. 1A.

The austenite and martensite phases are well known in the metallurgy industry and depend upon how the part is cooled. It is also possible for the material to be in the austenite phase in one location in the part, and be in the martensite phase in another location during a cooling process.

Metallurgists wish to obtain martensite at critical areas of the part for a hardening process.

The material's density in the austenite phase is different than its density in the martensite phase. This density difference is one main reason for a part to distort as one location of the part has a different volume changing rate than the other.

What has been found is that, contrary to what is believed in the industry, distortion can be limited or almost eliminated by subjecting the hot metal part to a slower and longer quenching operation which controls the temperature difference at various points on the hot metal part throughout the quenching operation. By keeping the temperature difference small by following a designed quench profile during controlled cooling, distortion is reduced while still converting the metal from an austenite phase to a martensite phase, while satisfying mechanical properties with little or no ferrite, pearlite or bainite formation.

It has also been discovered that the use of the disclosed method is capable of not only producing a martensite phase, but that some of the martensite phase may be a tempered martensite.

For high hardenability steels, one way to do this is to slowly reduce the surrounding temperature of the part. This can be done for example, by reducing the temperature by 1° C. and holding the part at that temperature until the entire part is at that temperature. Then reducing the surrounding temperature by another 1° C. and waiting for a sufficient time for all points of the part to reach that temperature, and proceeding to the next temperature. However, this process takes a very long time for large parts having large bulks of metal where the cooling is controlled by the core to surface distance, and the process can be detrimental to the mechanical properties.

One of ordinary skill will recognize that reducing the temperature is accomplished by introducing a quenchant into the quench unit.

The disclosed method of determining a quench profile for an improved quenching process starts with a metal part comprised of a metal material which is capable of having an austenite phase and a martensite phase. This material may be a single metal or an alloy of various metals. It may be possible that there are one or more metals, but the metal part must at least be capable of having an austenite phase and a martensite phase in the metal part. The inherent metal part properties of specific heat and thermal conductivity at quenching temperatures and in the respective solid austenite and martensite phase are used in the method and therefore need to be known.

This specification discloses a method for quenching a hot metal part. The method may include selecting a first node corresponding to about a slowest cooling portion of the hot metal part and a second node corresponding to about a fastest cooling portion of the hot metal part. One of ordinary skill will recognize that node refers to a specific point on the hot metal part. In the context of the method to quench the hot metal part, node and point may be used interchangeably. In the context of a method to develop a cooling schedule for the hot metal part according to a CAD geometry as described herein, node may also refer to a specific location within the CAD geometry.

The method may also include quenching the hot metal part to a finish temperature. The finish temperature is not considered important, but in general the finish temperature will be about room temperature (i.e.—about 25° C.).

During the quenching of the hot metal part it is preferred that a temperature difference exists between the first node and the second node. The temperature difference during the quench cycle may be between about 5° C. and about 30° C., between about 5° C. and about 25° C., between about 5° C. and about 20° C., between about 5° C. and about 15° C., between about 5° C. and about 10° C., between about 10° C. and about 30° C., between about 15° C. and about 30° C., between about 20° C. and about 30° C., or between about 25° C. and about 30° C.

The quench cycle may start from a first time when the second node is about 5° C. above a martensite start temperature of the specific metal or metal alloy, and may end at a second time when the first node is at a temperature which is about a martensite finish temperature of the specific metal or metal alloy. In some embodiments, the step of quenching the hot metal part may comprise exposing the hot metal part to a plurality of quench cycles. Each quench cycle may comprise introducing a first amount of a quenchant at a first quenchant temperature for a first quench time into a quench chamber containing the hot metal part. Subsequently, the quench cycle may comprise introducing at least a second amount of the quenchant at a second quenchant temperature below that of the first quenchant temperature for a second quench time into the quench chamber. The number of amounts of the quenchant, quenchant temperatures, and quenchant times is not considered important, and will vary based on a number of factors including the size and shape of the hot metal part being quenched, the specific type of quenchant being used, and the characteristics of the quench chamber. For instance, in some embodiments there may be a third amount of the quenchant at a third quenchant temperature below that of the second quenchant temperature for a third quench time, a fourth amount of the quenchant at a fourth quenchant temperature below that of the third quenchant temperature for a fourth quench time, and so on.

In some embodiments, the first amount of a quenchant and the at least a second amount of a quenchant are each independently of a type of quenchant selected from the group consisting of air, steam, water mist, and nitrogen. Each amount of a quenchant may be of the same or different types of quenchant. For example, in some embodiments, the first amount of a quenchant and the at least a second amount of a quenchant may each be nitrogen. As another example, in some embodiments, the first amount of a quenchant may be nitrogen while the second amount of a quenchant may be water mist.

Figure 1A:
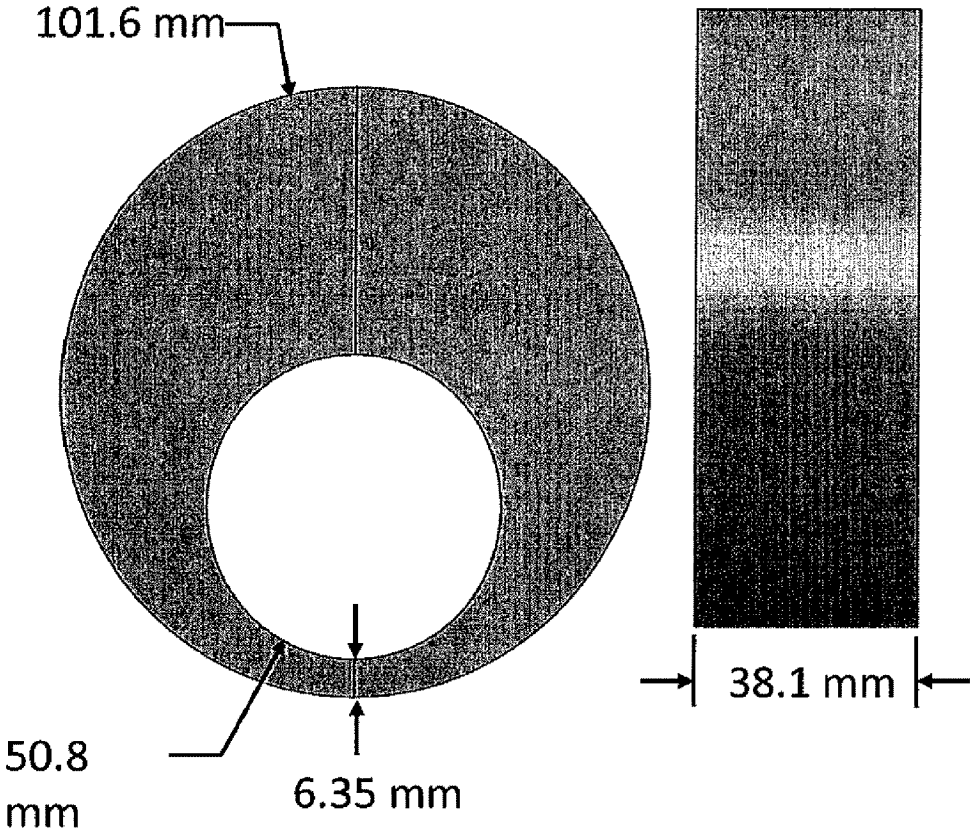
FIG. 1A depicts the dimensions of the offset hole disk part shown as an example in this specification.

The method may be conducted according to a quenching schedule. This specification also discloses a method for determining a quenching schedule more rapidly cooling a hot metal part to form martensite. The method may comprise several steps. The first step, as demonstrated in FIG. 1, may involve determining a computer-aided design (CAD) geometry of the metal part This CAD geometry may be in multiple dimensions, with two dimensions and three dimensions being the most common, with three dimensions being the most preferred.

The method assumes, but does not require, that the known heat transfer coefficient is uniform on the entire part surface. A typical heat transfer coefficient for a slow cooling process is 50 $W/m^2K$. The quench unit, which is defined as the physical unit itself, the flow rate and the quenchant used in the treatment will define what are known as thermal boundary conditions. The quench unit used to quench a hot metal part will have a heat transfer coefficient which is a measure of how fast a fluid can remove heat from a solid's surface in the unit. It is well known that each quench unit will have its own unique range of heat transfer coefficient. While it is known within the art how to determine this for a given unit, the heat transfer coefficient is typically provided by the quench unit supplier as part of the specification. The examples used in this simulation had the following thermal boundary conditions, which, in part, is how fast a system can recover to the set point temperature from a known mass at a known temperature. The recovery is from the cooling of the gas quenchant from the cool air that enters with the hot part. This cool air drops the temperature of the gas quenchant from the set point hold temperature. The curve will have a rise in quenchant temperature caused by the hot part, with a subsequent fall in temperature as the part is cooled to the set point of approximately room temperature. One wants to replicate the mass and initial temperature to be used in production as closely as possible.

The following table (Table 1), is the recovery time for the quench unit, having a Heat Transfer Coefficient of 95 $W/(m^2*K)$ [Watts/(square meter*degree Kelvin)].

TABLE 1

Thermal Boundary Conditions of Quench Unit.

| Time (Seconds) | Temperature (° C.) |
|---|---|
| 0 | 250 |
| 30 | 325 |
| 120 | 393 |
| 12000 | 393 |

In this case, the set point was 393° C., and is the martensite start temperature of the material.

Figure 2:
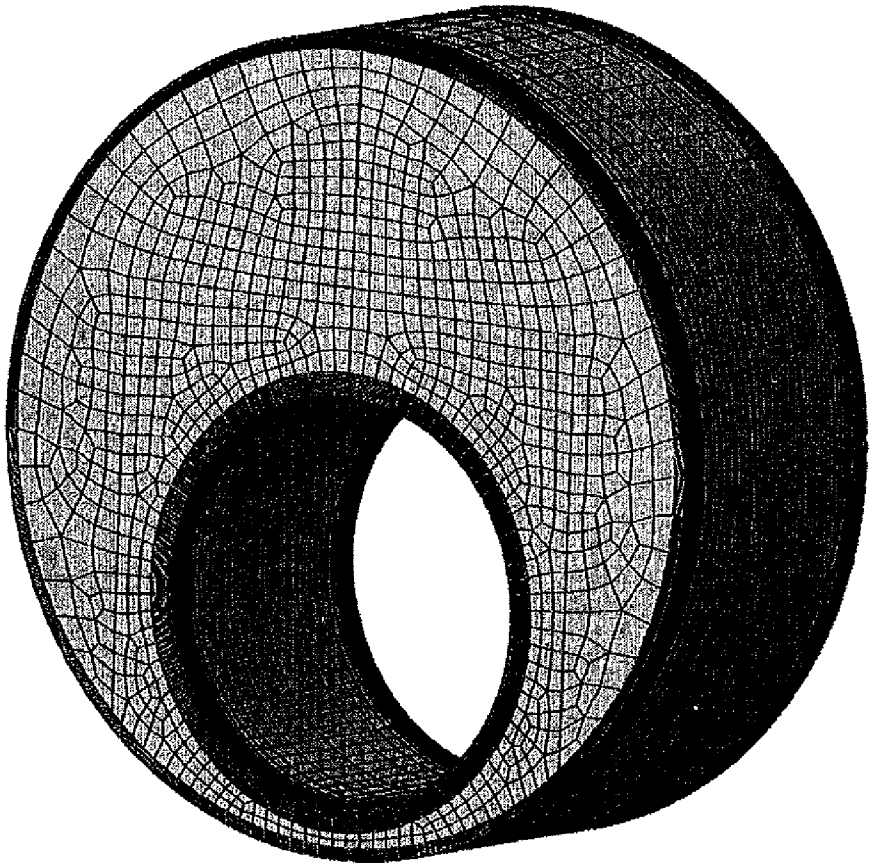
FIG. 2 is a depiction of a finite element mesh of the CAD geometry.

After the CAD rendering, known as a CAD geometry, one creates a finite element mesh from the CAD geometry, an example of which is shown in FIG. 2. Creating a finite element mesh is well known in the art.

Next, one selects or obtains a generic cooling schedule for the hot metal part. The generic cooling schedule is the temperature and time conditions to which the part will be exposed. Example schedule conditions could be 1° C. drop each minute until stopped, or 2° C. drop every 5 minutes. The generic cooling schedule forms the starting point from which the actual cooling schedule will be determined. Table 2 shows a typical generic cooling schedule.

TABLE 2

Generic Cooling Schedule

| Time (Seconds) | Temperature (° C.) |
|---|---|
| 0 | 250 |
| 30 | 325 |
| 90 | 350 |
| 120 | 393 |
| 2500 | 393 |
| 4300 | 60 |
| 10800 | 60 |

In this schedule, the italicized values are the time it takes the quench unit to recover from the introduction of the hot metal part to the quench chamber. It takes 120 seconds to recover to 393° C. Accordingly, these conditions cannot be modified or changed. In this generic schedule, 393° C. is the temperature corresponding to the martensite start temperature ($M_S$) for the metal of the hot metal part. The martensite start temperature is the temperature at which the particular material of the hot metal part first begins to transition from the austenite phase to the martensite phase. It is held for 2380 seconds (Note: 2380-2500-120). There is then a ramp of 1800 seconds to go to point number 2, 60° C. 60° C. is the approximate martensite finish temperature of the material ($M_F$). (Note: 4300-2500-1800). The martensite finish temperature is the temperature at which the particular material of the hot metal part has completed the transition from the austenite phase to the martensite phase. The part is then held at a time chosen to be longer than the assumed time needed to reach thermal equilibrium throughout the part with the second temperature. The actual time to reach thermal equilibrium is then determined at some time during the excessively long hold.

Accordingly, the generic cooling schedule comprises at least a first temperature maintained for a first cooling time, and at least a second temperature maintained for a second cooling time. As mentioned previously, this is merely a starting schedule. The first temperature is typically less than the initial surface temperature of the hot metal part, but above or equal to the martensite start temperature ($M_S$) of the hot metal part. The second temperature will be less than the first temperature and less than or equal to the martensite start temperature, and preferably less than or equal to the martensite finish temperature.

The model selects conditions which change fast enough, i.e. cool fast enough, to create the temperature differentials between the coldest node and the hottest node as described herein.

The practitioner will then execute a first finite element analysis using the generic cooling schedule and the thermal boundary conditions to identify a first node of the hot metal part on the finite element mesh which is the hottest node and a second node on the finite element mesh which is the coolest node. These nodes are demonstrated in FIG. 3.

Figure 3:
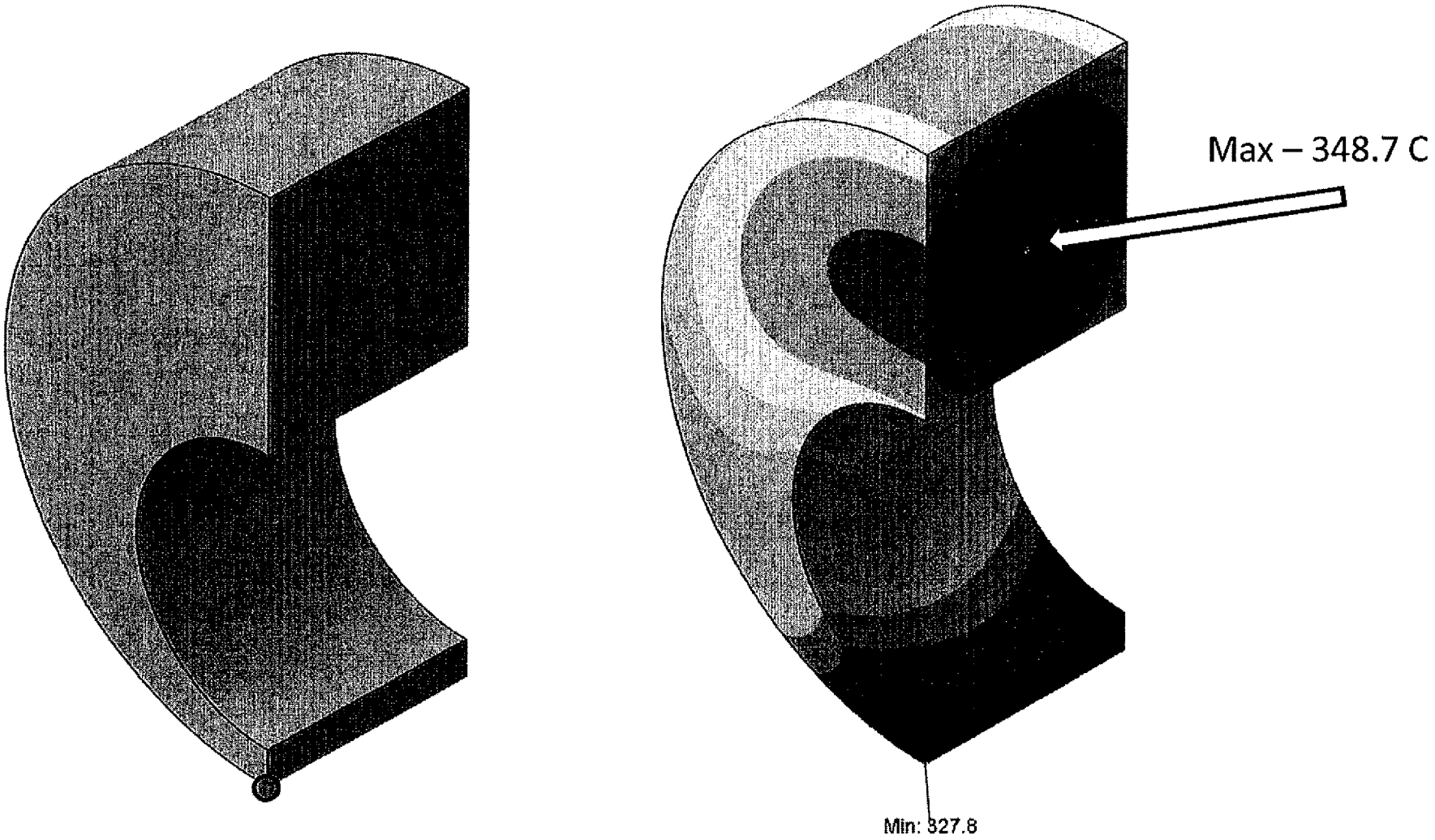
FIG. 3 is a temperature profile of a cross section of a hot metal part demonstrating the location of the hottest and coldest points during a cooling curve.

It is important to note that, in the three dimensional model, the hottest node is likely to be "inside" the hot metal part. It has been determined that these nodes will have the same hot vs cold relationship to the other nodes throughout the cooling cycle. Accordingly, the same two nodes will be the hottest and coldest nodes, respectively, regardless of which initial two temperatures are selected. Referring to FIG. 3, the hottest and coldest points are identified. However, these same points will always be present, even if there are other points sometimes having the same temperature as these points.

Executing a finite element analysis along a cooling schedule is well known in the art and conducted using commercial computer programs. For example, DANTE Solutions, Inc.'s, DANTE® program, Cleveland, Ohio is one such program with these capabilities.

After completing the first finite element analysis, one iteratively modifies the generic cooling schedule using at least a second finite element analysis to create a finished cooling schedule wherein the finished cooling schedule is such that the temperature difference between the first node and the second node during the solid phase transformation of the first node and the second node from the austenite phase to the martensite phase is preferably no greater than 30° C., with 20° C. being more preferred, and 10° C. being the most preferred. This phase transformation starts at the martensite start temperature ($M_S$) and ends at the martensite finish temperature ($M_F$).

Iteratively modifying time and temperature conditions involves creating a cooling schedule (n, where n=1), executing a finite element analysis (n) examining the temperature difference between the hottest node and the coldest node for those conditions (Quenchant Temperature and time at that temperature) where the difference between the hottest node and the coldest node during the phase transformation of the hottest node and the coldest node from the austenite phase to the martensite phase is greater than a target temperature difference, preferably below 30° C. (i.e. during the martensite phase transformation) and changing the conditions of the cooling schedule to create a new cooling schedule (n+1) to reduce that temperature difference. Finite element analysis (n+1) is conducted and the examination of the temperature difference between the hottest and coldest nodes for the conditions where the difference is greater than the 30° C. target temperature is done again. This process continues until the temperature difference during the cooling schedule is less than 30° C., preferably less than 25° C., with less than 20° C. being more preferred and less than 15° C. or less than 10° C. being the most preferred.

Once this temperature difference is no greater than the target difference, the iterative process stops and the cooling schedule resulting in the reduced temperature difference can be used to quench the part.

What follows is an example iteration.

Figure 4:
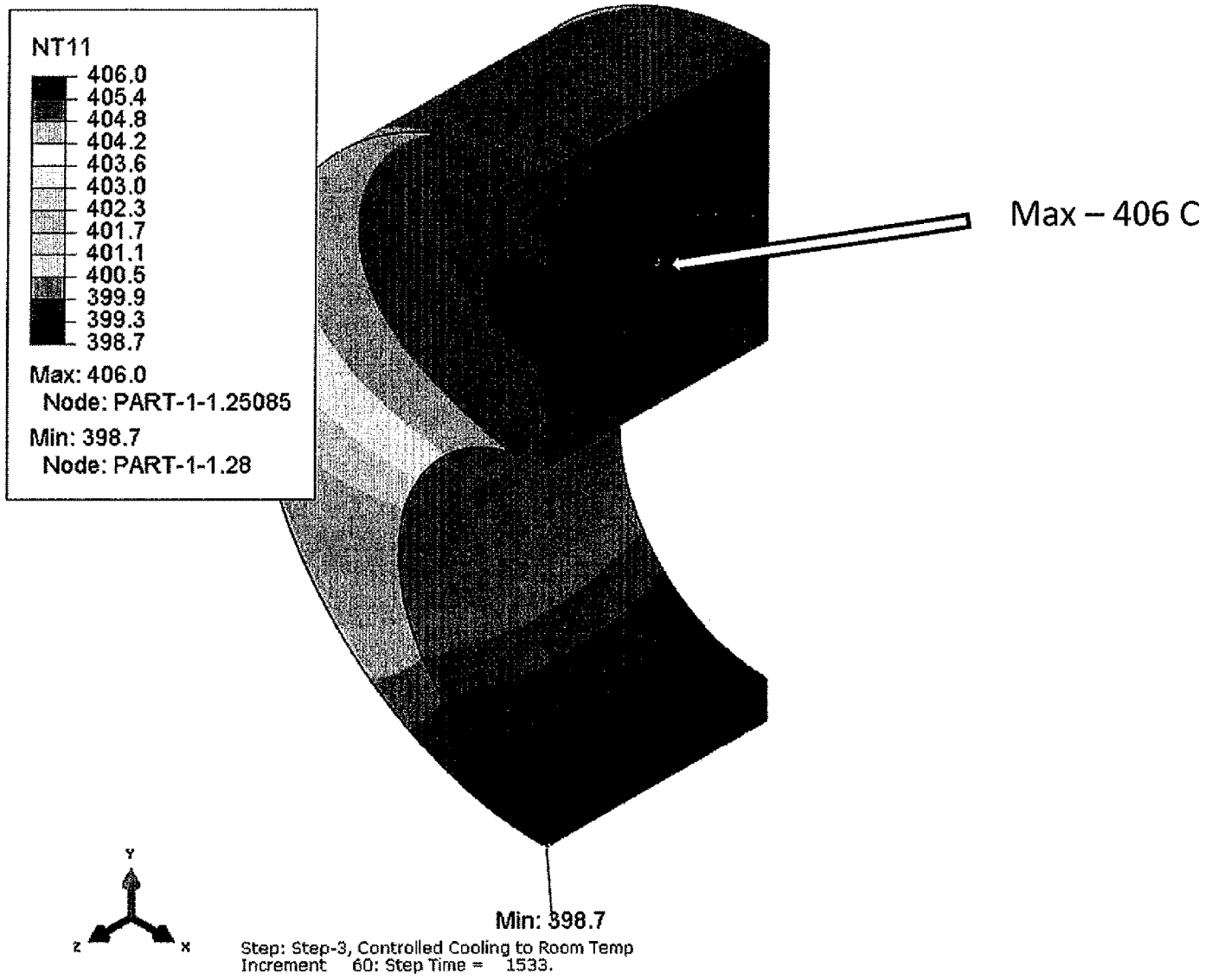
FIG. 4 is a depiction of the hot metal part processed according to the generic cooling schedule.

Examining FIG. 4, which is the output from the generic cooling schedule simulation, the difference between the hottest node and the coldest node is approximately 7° C. at 1533 seconds and within 15° C. of 393° C. The actual difference is not so critical, provided it is below the target value. This forms the end of the first hold at the $M_S$ temperature. This effectively brings the part at the start of the $M_S$ temperature.

Figure 5:
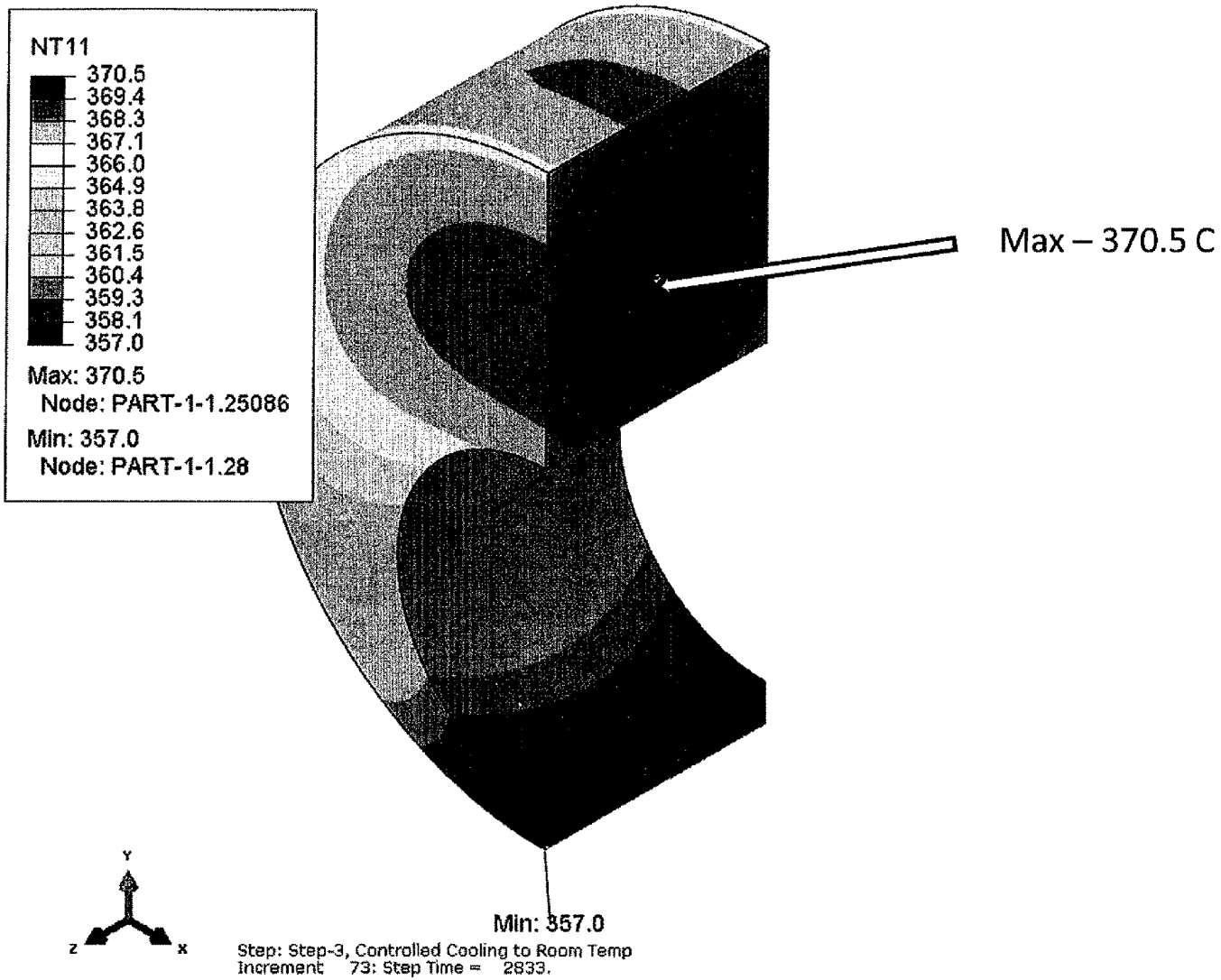
FIG. 5 is a depiction of the hot metal part processed according to the generic cooling schedule.

Then one examines the temperature profiles of the generic cooling schedule. Looking at FIG. 5, the total time is 2833 second, (2833-2500)=333 seconds. As the part is 370° C. internally, the temperature of 370° C. is chosen and held for 333 seconds.

Ramp time is from the end of the previous hold time to the start of the next hold time. The ramp time is assumed to be 50% of the time from the end of the previous hold time to the start of the next hold time. So, for the ramp time from 393° C. to 370° C., the total time is 333 seconds, so the ramp time is 166.5 seconds and the actual hold time is 166.5 seconds. This is an arbitrary selection, one could use 25% ramp and 75% hold or any other ramp vs. hold ratio. The subsequent simulation will tell whether this is correct or not.

Figure 6:
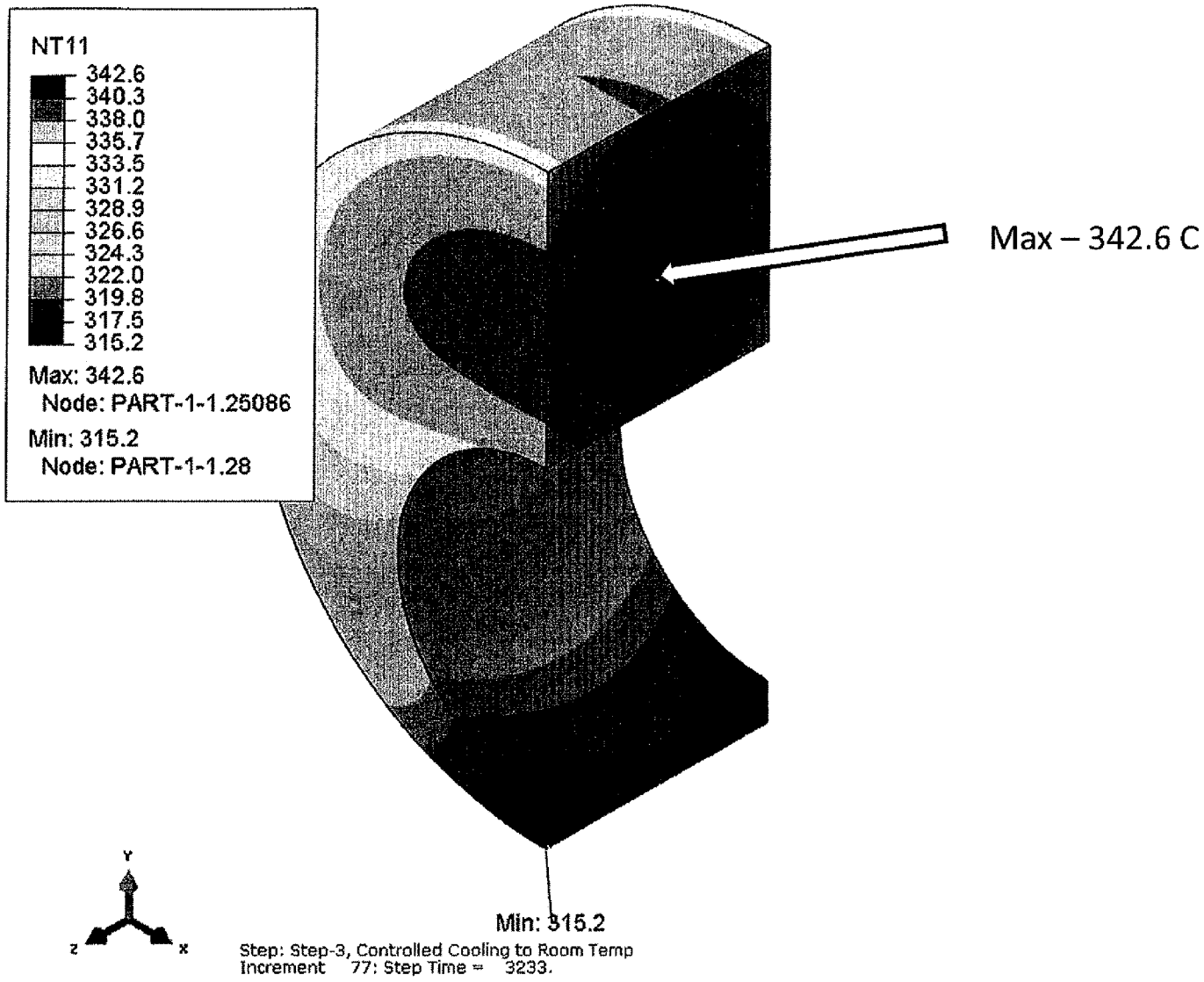
FIG. 6 is a depiction of the hot metal part processed according to the generic cooling schedule.

The analyst continues building the new curve by examining the profile across the part as time progresses in the generic cooling curve. In this case, examining FIG. 6, the step time is 3233 seconds and the node temperature difference is 27° C. after 733 seconds (3233-2500). This new time of 733 seconds is added to the 1533 seconds to get 2266 seconds for the end of the hold at 330° C., the difference between the $T_{max}$ and $T_{min}$.

Figure 7:
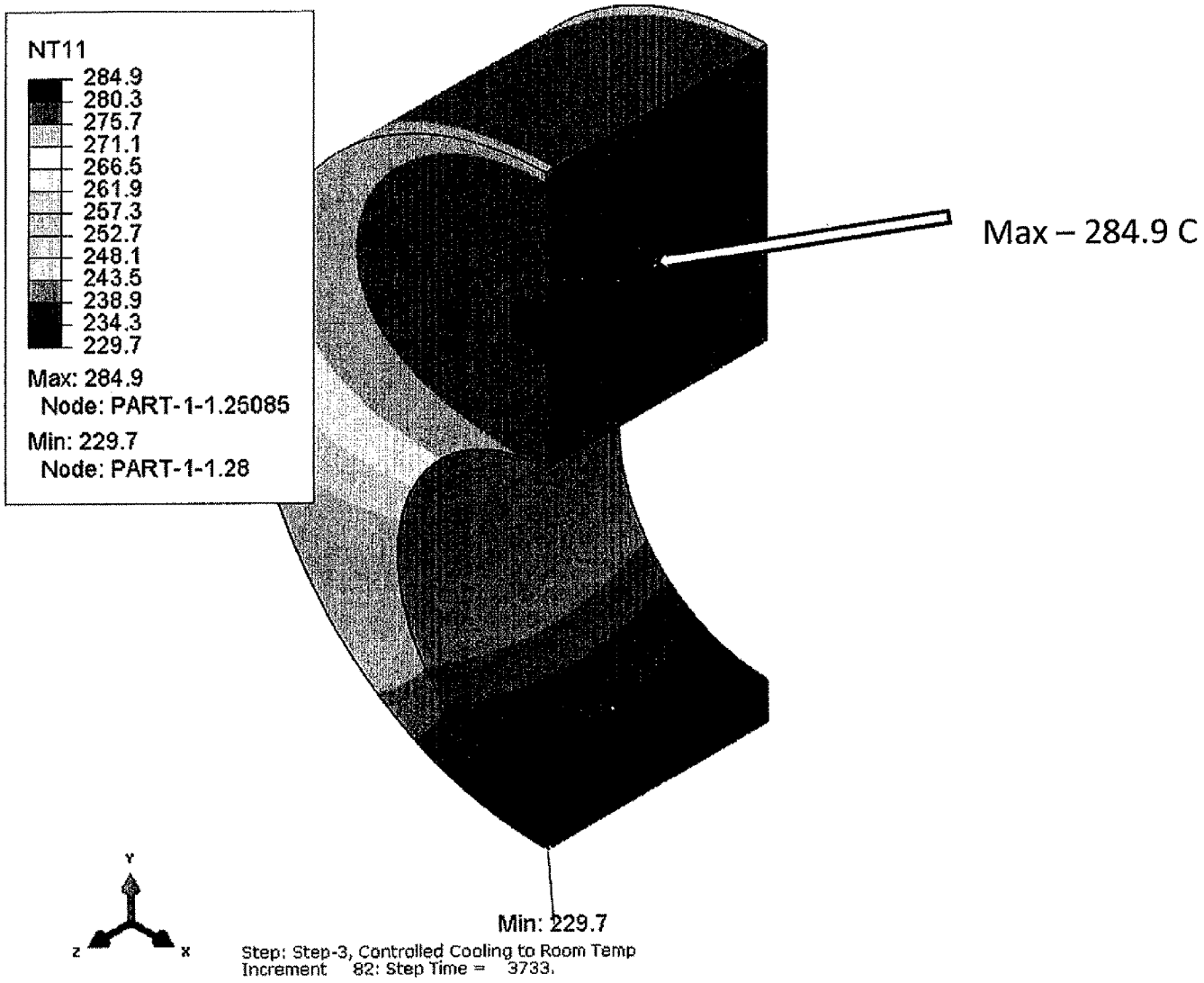
FIG. 7 is a depiction of the hot metal part processed according to the generic cooling schedule.
Figure 8:
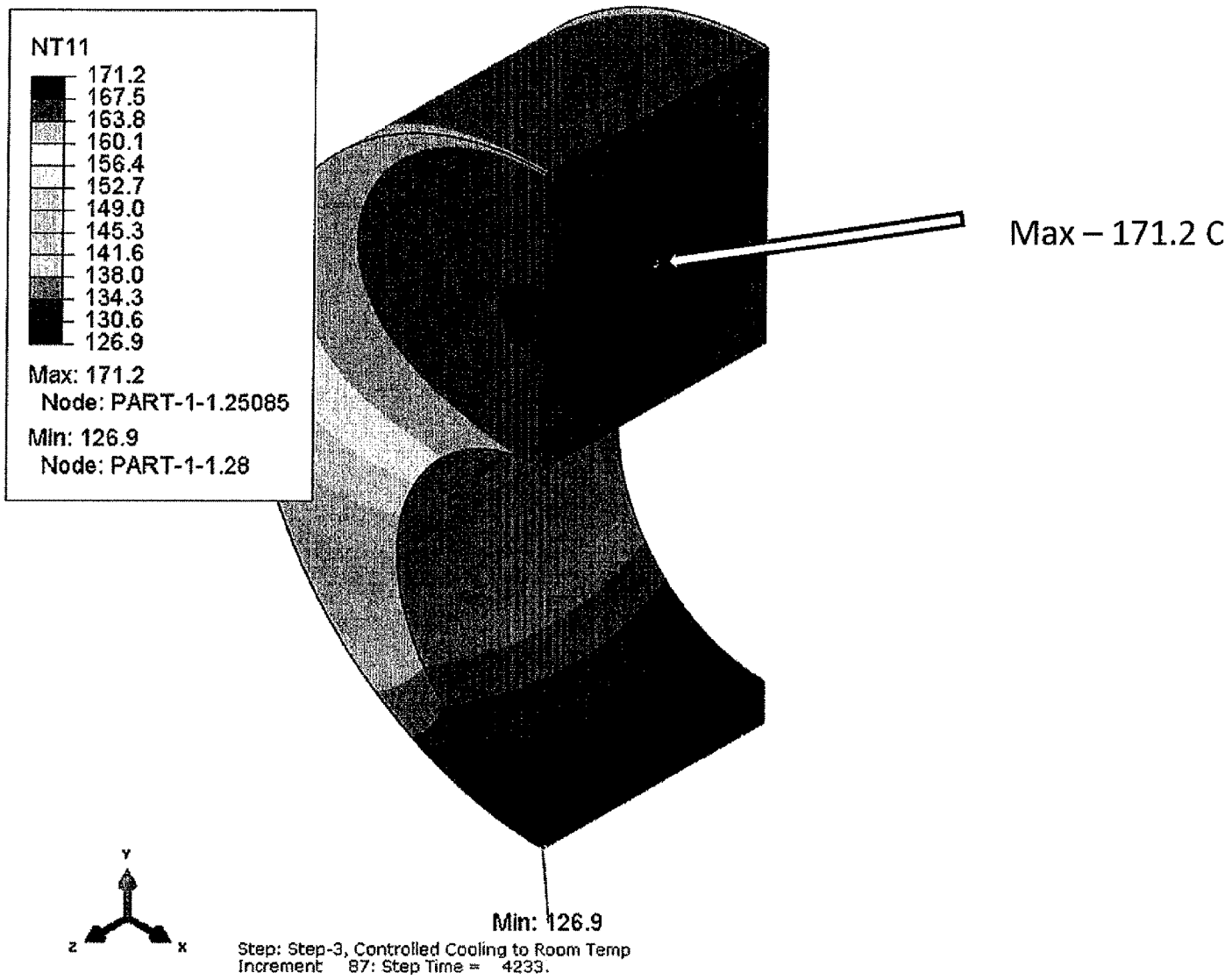
FIG. 8 is a depiction of the hot metal part processed according to the generic cooling schedule.
Figure 9:
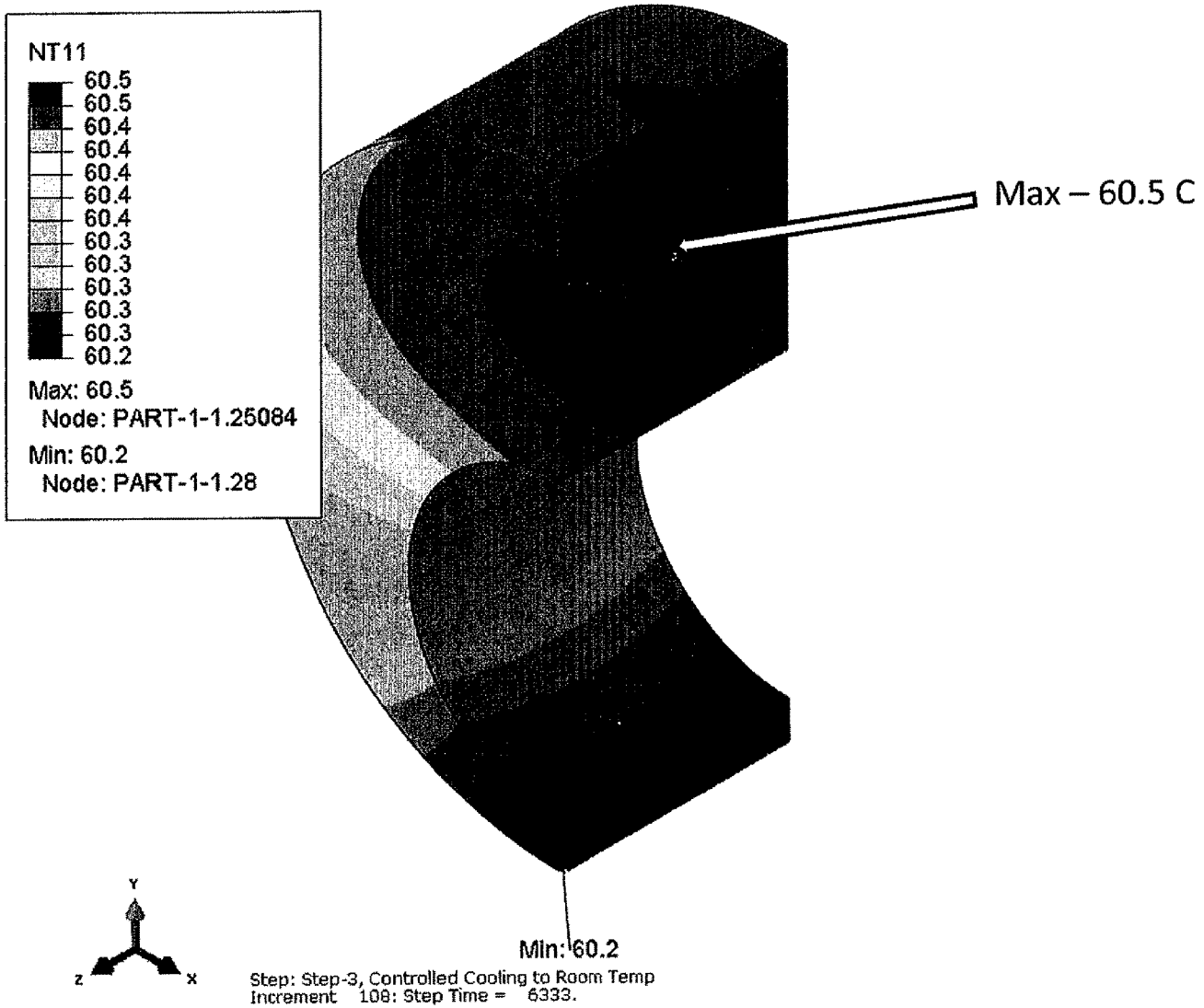
FIG. 9 is a depiction of the hot metal part processed according to the generic cooling schedule.

The curve is continued to be built. As shown in FIG. 7, 250° C. is chosen after 1233 seconds (3733-2500). This is added to 1533 seconds to get 2766 seconds. By the same analysis, referring to FIGS. 8 and 9, the additional points of 150° C./3266 seconds and 60° C./5366 seconds, respectively.

TABLE 3

Iteration 1 of The Generic Cooling Schedule.

| Points | Total Time of Simulation Start of Hold (End of Ramp), (Seconds) | Total Time of Simulation End of Hold, (Seconds) | Temperature (° C.) |
|---|---|---|---|
| Cannot be changed | 0/no hold | | 250 |
| Cannot be changed | 3/no hold | | 325 |
| Cannot be changed | 90/no hold | | 350 |

TABLE 3-continued

Iteration 1 of The Generic Cooling Schedule.

| Points | Total Time of Simulation Start of Hold (End of Ramp), (Seconds) | Total Time of Simulation End of Hold, (Seconds) | Temperature (° C.) |
|---|---|---|---|
| Cannot be changed | 120/no hold | | 393 |
| 1 | | 1533 | 393 |
| 2 | 1699.5 (1533 + 166.5) | 1866 (1533 + 333) | 370 |
| 3 | 2066 (1866 + 36 | 2266 (1533 + 733) | 330 |
| 4 | 2516 | 2766 (1533 + 1233) | 250 |
| 5 | 3016 | 3266 (1533 + 1733) | 150 |
| 6 | 4316 | 5366 (1533 + 3833) | 60 |

The simulation is run using the above cooling schedule and analyzed for the locations where the temperature differences during the $M_S$ to $M_F$ may be greater than the target temperature.

Table 4 shows the second iteration which is built as follows.

Figure 10:
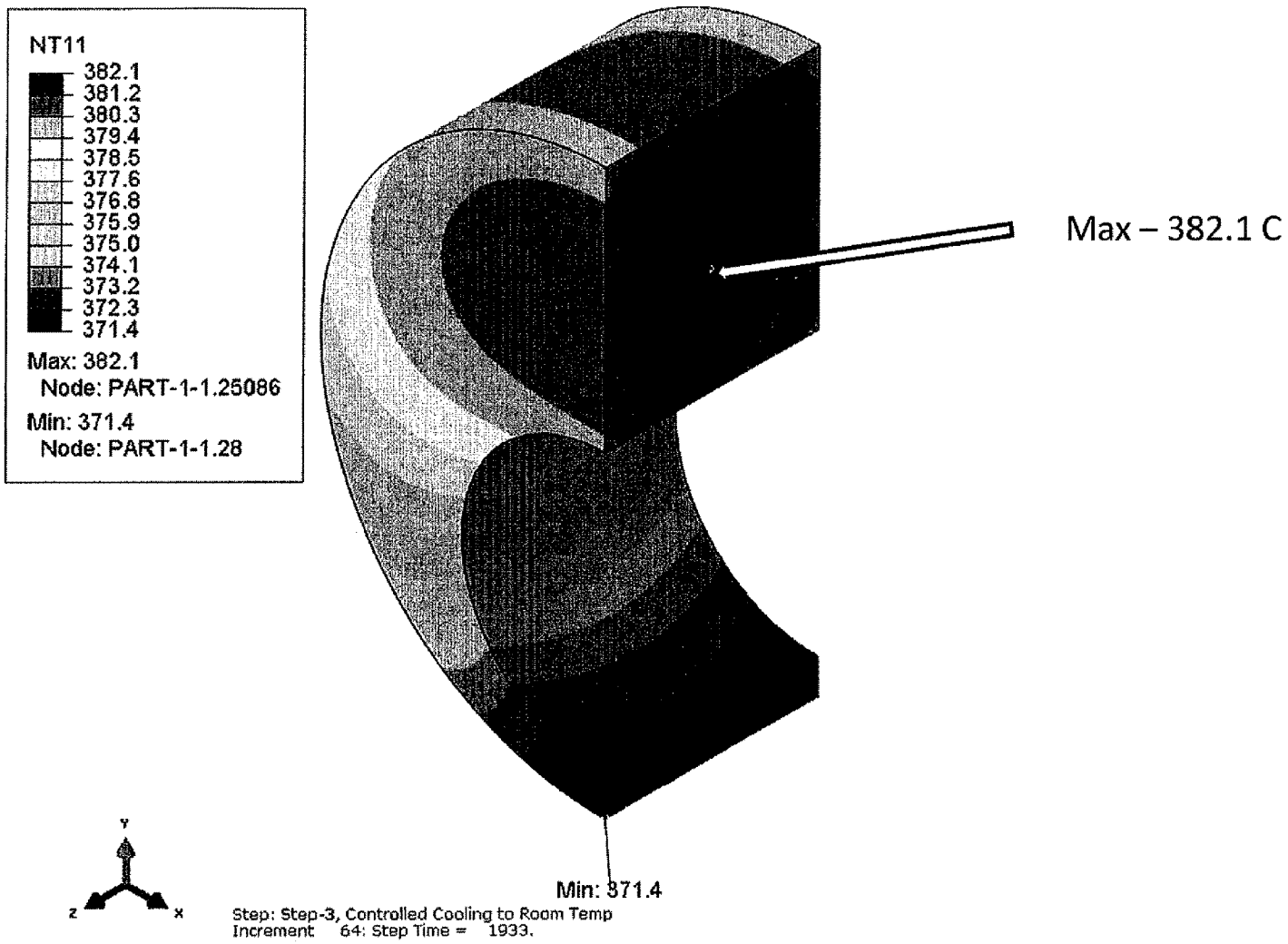
FIG. 10 is a depiction of the hot metal part processed according to the first iteration of the generic cooling schedule.

As shown in FIG. 10, the profile shows that at 1933 seconds, the colder temperature is at 370° C. (the set temperature) with only 20° C. difference between the two points. A longer hold is therefore needed at 370° C. This was set at 2000 seconds total time.

Figure 11:
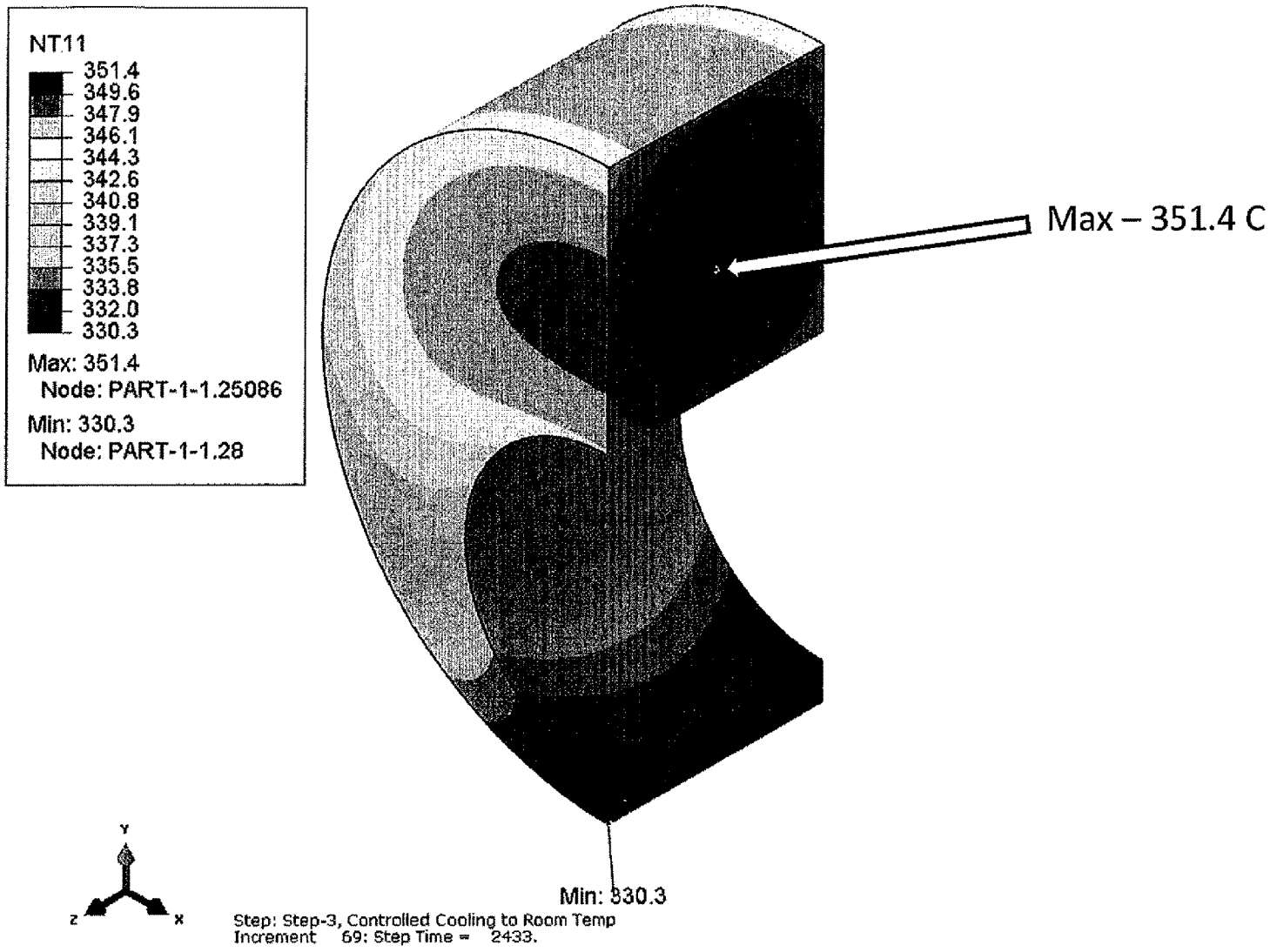
FIG. 11 is a depiction of the hot metal part processed according to the first iteration of the generic cooling schedule.

Examining FIG. 11, it is evident that at 2433 seconds the two points are outside the target temperature difference of 20° C., with one point at the target temperature of 330° C., therefore a longer hold time is needed at 330° C. A total time of 2400 seconds was set.

Figure 12:
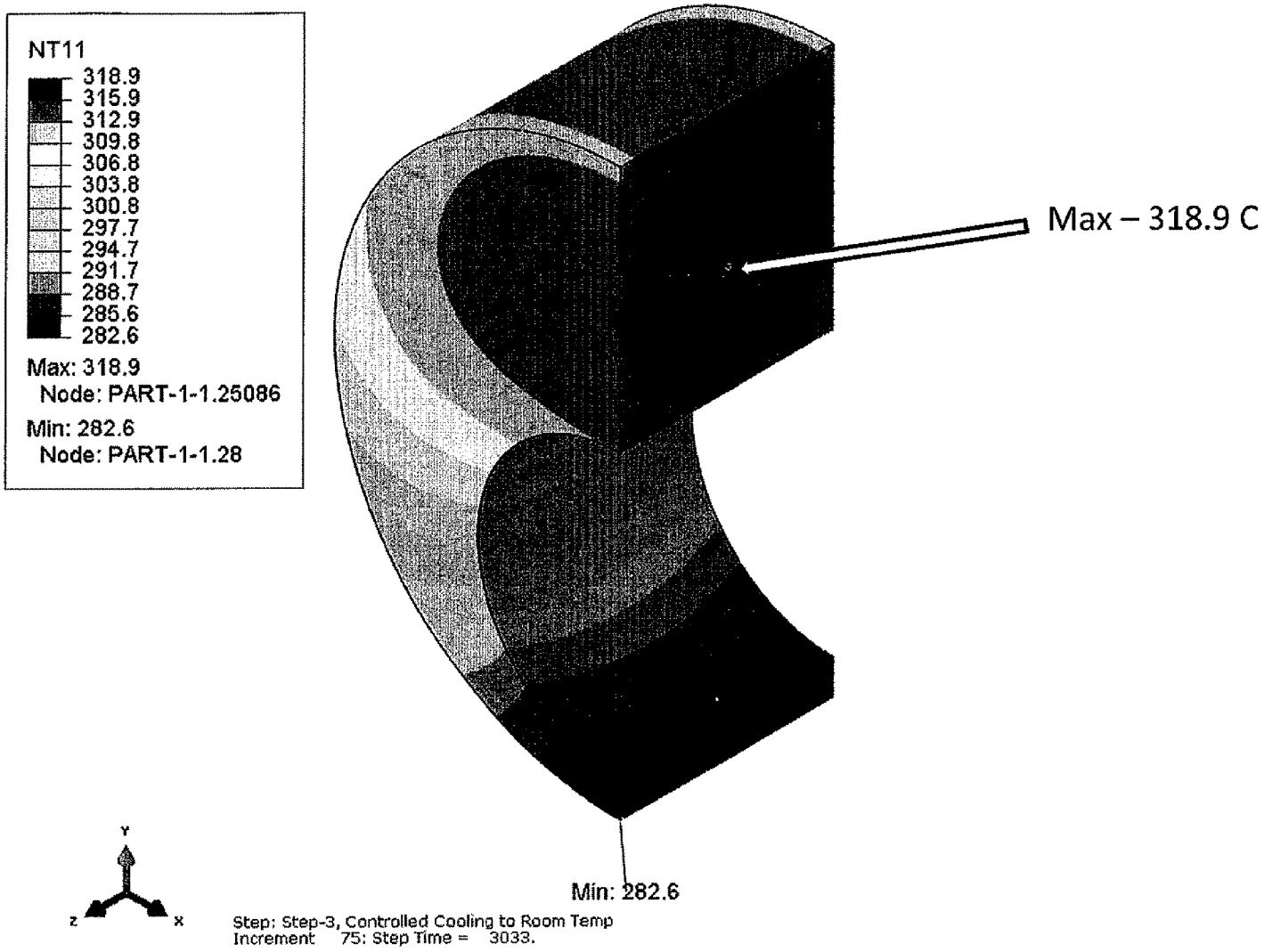
FIG. 12 is a depiction of the hot metal part processed according to the first iteration of the generic cooling schedule.

Examining FIG. 12, at 3033 seconds the two nodes have a difference greater than the target temperature and neither point is at the set temperature. The soak time/hold time needs to be increased. As the difference is getting large, one can just add the additional time needed up to this point to the remaining points on the curve and rerun the simulation.

Iterations to the cooling schedule continue in the manner described above until the $1^{st}$ point and the $2^{nd}$ point satisfy the target temperature difference from the martensite start temperature to the martensite finish temperature.

TABLE 4

Second Iteration of the Cooling Curve.

| Points | Total Time of Simulation Start of Hold (End of Ramp), (Seconds) | Total Time of Simulation End of Hold, (Seconds) | Temperature (° C.) |
|---|---|---|---|
| Cannot be changed | 0/no hold | | 250 |
| Cannot be changed | 3/no hold | | 325 |
| Cannot be changed | 90/no hold | | 350 |
| Cannot be changed | 120/no hold | | 393 |
| 1/7 | | 1533 | 393 |
| 8 | 1766.5 | 2000 | 370 |
| 9 | 2200 | 2400 | 330 |
| 10 | 2700 | 3000 | 250 |

TABLE 4-continued

Second Iteration of the Cooling Curve.

| Points | Total Time of Simulation Start of Hold (End of Ramp), (Seconds) | Total Time of Simulation End of Hold, (Seconds) | Temperature (° C.) |
|---|---|---|---|
| 11 | 3317 | 3634 | 150 |
| 12 | 4500 | 5366 | 60 |

Table 5 shows the out of round distortion of the offset ring part when processed according to different Heat Transfer Coefficients (HTC) and the iterated cooling schedule generated according the disclosed process. In this case, the target temperature difference was 15° C. Looking at the table, the maximum temperature differences experienced by the part during the phase transformation from austenite to martensite can be as high as 310° C. creating tremendous out of round distortions. As compared to even a slow cooling part in a chamber having a heat transfer coefficient of 20 $W/m^2K$, the disclosed cooling schedule experiences 50% less distortion. The values of 20 $W/m^2K$, 50 $W/m^2K$, and 100 $W/m^2K$ are known HTC's used within the industry. The iterated curve has an HTC of 95 $W/m^2K$ for that unit as discussed earlier. The difference is the iterated curve varied the temperature according to the schedule created using the disclosed method.

TABLE 5

Distortion Results of Various Cooling Schedules
Disk with Offset Hole

| HTC ($W/m^2 * K$) | Max ΔT (° C.) | Max ΔM during Trans. (%) | Vertical Distortion (mm) | Horizontal Distortion (mm) | Out of Round Distortion (mm) |
|---|---|---|---|---|---|
| 20 | 71 | 47 | 0.0225 | −0.0211 | 0.0436 |
| 50 | 177 | 76 | 0.0517 | −0.0400 | 0.0917 |
| 100 | 310 | 89 | 0.0878 | −0.0634 | 0.1512 |
| Iterated Curve | 15 | 13 | 0.0382 | 0.0106 | 0.0276 |

Given a steel's alloying elements and a given cooling rate, mechanical properties can remain ideal while significantly reducing distortion caused by quenching. The alloy investigated, Ferrium C64, has high hardenability and a high tempering temperature; although this method may not degrade the mechanical properties of steels with a different hardenability and tempering temperature. The hardness profiles through a carburized case, tensile properties, Charpy impact properties, and distortion are compared between the standard quenching process and the process described herein for the investigated alloy.

Other embodiments for obtaining the cooling schedule may exist. In one embodiment, the method may be conducted according to an empirically determined quenching schedule. The empirically determined quenching schedule may be determined by first placing a first temperature measurement device at the first node and a second temperature measurement device at the second node, and then iteratively exposing the hot metal part to a quenchant at various temperatures and times so as to characterize the temperature difference during the quench cycle. One preferred first temperature measurement device and/or second temperature measurement device is a thermocouple.

In another embodiment, the method may be conducted according to a quenching schedule determined in real time during the quenching step. The real time determined quenching schedule may be determined by measuring a temperature of the first node using a first temperature measurement device and a second temperature of the second node using a second temperature measurement device while the hot metal part is exposed to a quenchant at a quenchant temperature, and then adjusting the quenchant temperature to maintain the temperature difference during the quench cycle. One preferred first temperature measurement device and/or second temperature measurement device is a themocouple.

Figure 13:
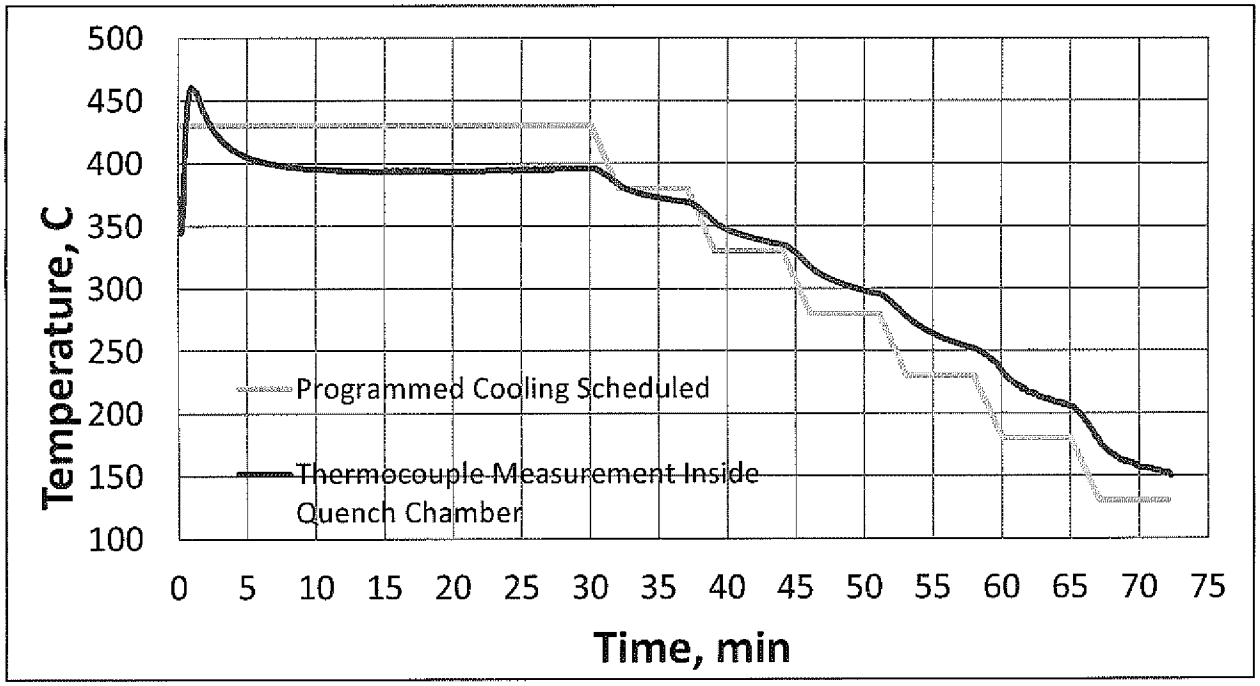
FIG. 13 is a depiction of a cooling schedule and thermocouple measurements used in the examples herein.

FIG. 13 shows the cooling schedule used to process the parts with the quenching process described herein and the thermocouple measurement inside the quench chamber during the process.

Figure 14:
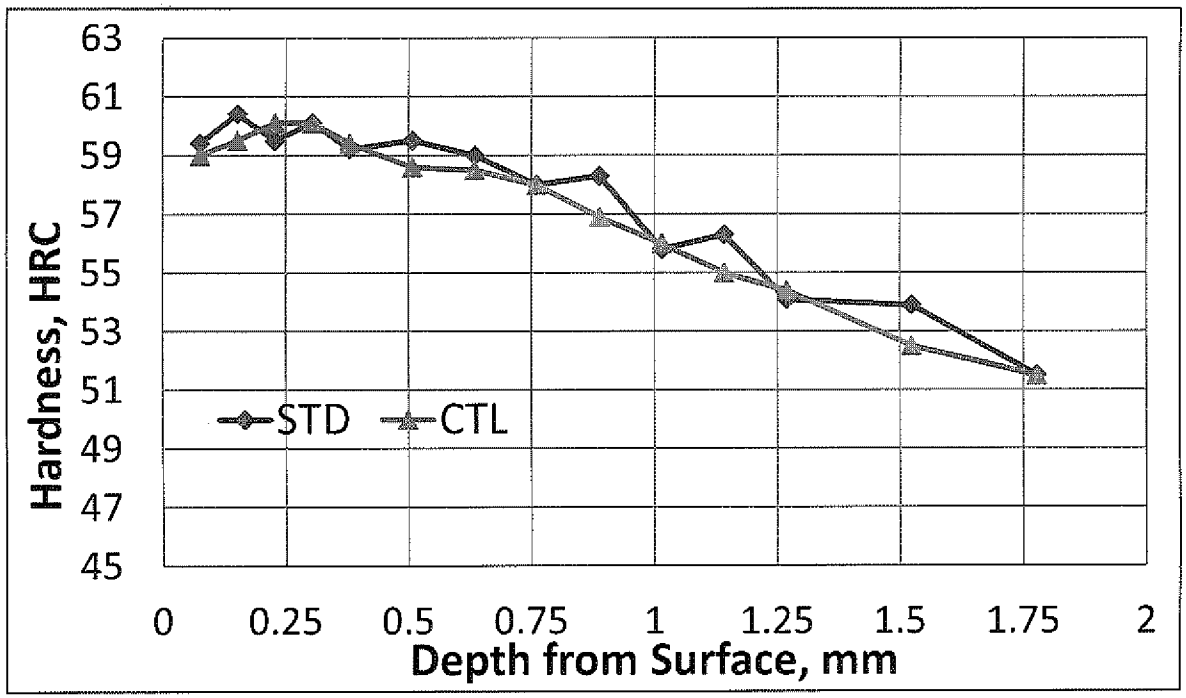
FIG. 14 is a hardness comparison between the examples herein.

FIG. 14 shows the hardness comparison between the standard process (labeled "STD") and the process described herein (labeled "CTL").

Table 6 shows the tensile property comparison between the standard process (labeled "STD") and the process described herein (labeled "CTL").

TABLE 6

Tensile Property Comparison Between a Standard Quenching Process (STD) and the process described herein (CTL)

| SAMPLE ID | | TENSILE (psi) | | YIELD OS .2% (psi) | | ELONGATION 4D(%) | | RA (%) | |
|---|---|---|---|---|---|---|---|---|---|
| STD | CTL | SID | CTL | SID | CTL | SID | CTL | SID | CTL |
| 01L | 1-1 | 236,000 | 237,000 | 203,000 | 202,000 | 17.0 | 18.0 | 71.0 | 73.0 |
| 02L | 2-1 | 236,000 | 236,000 | 203,000 | 200,000 | 17.0 | 18.0 | 71.0 | 70.0 |
| 03L | 3-1 | 235,000 | 237,000 | 203,000 | 199,000 | 17.0 | 18.0 | 71.0 | 70.0 |
| 04L | 4-1 | 236,000 | 234,000 | 204,000 | 214,000 | 16.0 | 17.0 | 71.0 | 72.0 |
| AVG | | 235,750 | 236,000 | 203,250 | 203,750 | 16.8 | 17.8 | 71.0 | 71.3 |

Table 7 shows the impact Charpy property comparison between the standard process (labeled "STD") and the process described herein (labeled "CTL").

TABLE 7

Charpy impact property comparison between a standard quenching process (STD) and the process described herein (CTL)

| | STD | | CTL | |
|---|---|---|---|---|
| | SAMPLE ID | CVN ENERGY (ft. lbs.) | SAMPLE ID | CVN ENERGY (ft. lbs.) |
| Set 1 | 11L | 17.0 | 1-1 | 18.0 |
| Comparison | 12L | 20.0 | 1-2 | 21.0 |
| | 13L | 17.0 | 1-3 | 20.0 |
| | AVG | 18.0 | AVG | 19.7 |
| Set 2 | 21L | 19.0 | 2-1 | 19.0 |
| Comparison | 22L | 15.0 | 2-2 | 18.0 |
| | 23L | 18.0 | 2-3 | 16.0 |
| | AVG | 17.3 | AVG | 17.7 |
| TOTAL AVG | STD | 17.7 | CTL | 18.7 |

Table 8 shows the distortion comparison between the standard process (labeled "STD") and the process described herein (labeled "CTL"). The distortion measured the out of round of the hole in the coupon depicted in FIG. 1A.

Table 8—Comparison of out-of-round distortion of coupons processed using standard quenching process (STD) and process described herein (CTL); EW and NS measurements are relative, Out-of-round measurements are absolute.

| STD Coupon #1 | | | | Out-of-round (mm) |
|---|---|---|---|---|
| EW1 | 0.46 | NS1 | 0.28 | 0.18 |
| EW2 | 0.53 | NS2 | 0.30 | 0.23 |
| EW3 | 0.52 | NS3 | 0.30 | 0.22 |
| EW4 | 0.51 | NS4 | 0.32 | 0.19 |
| EW5 | 0.51 | NS5 | 0.23 | 0.28 |
| | | | AVG. | 0.220 |

| STD Coupon #2 | | | | Out-of-round (mm) |
|---|---|---|---|---|
| EW1 | 0.55 | NS1 | 0.30 | 0.25 |
| EW2 | 0.51 | NS2 | 0.30 | 0.21 |
| EW3 | 0.51 | NS3 | 0.30 | 0.21 |
| EW4 | 0.50 | NS4 | 0.29 | 0.21 |
| EW5 | 0.46 | NS5 | 0.21 | 0.25 |
| | | | AVG. | 0.226 |

-continued

| CTL Coupon #1 | | | | Out-of-round (mm) |
|---|---|---|---|---|
| EW1 | 0.30 | NS1 | 0.19 | 0.11 |
| EW2 | 0.30 | NS2 | 0.21 | 0.09 |
| EW3 | 0.31 | NS3 | 0.24 | 0.07 |
| EW4 | 0.35 | NS4 | 0.25 | 0.10 |
| EW5 | 0.38 | NS5 | 0.28 | 0.10 |
| | | | AVG. | 0.094 |

| CTL Coupon #2 | | | | Out-of-round (mm) |
|---|---|---|---|---|
| EW1 | 0.46 | NS1 | 0.34 | 0.12 |
| EW2 | 0.44 | NS2 | 0.32 | 0.12 |
| EW3 | 0.41 | NS3 | 0.28 | 0.13 |
| EW4 | 0.41 | NS4 | 0.29 | 0.12 |
| EW5 | 0.41 | NS5 | 0.33 | 0.08 |
| | | | AVG. | 0.114 |

What is claimed is:

1. A method of quenching a hot metal part composed of a specific metal or metal alloy capable of having an austenite phase, a martensite phase, and inherent metal properties of a first specific heat and a first thermal conductivity in the austenite phase and a second specific heat and a second thermal conductivity in the martensite phase, comprising the steps of:

A. selecting a first point located at, or about, a slowest cooling point of the hot metal part and a second point located at, or about, a fastest cooling point the hot metal part, and B. quenching the hot metal part with the requirement that a temperature difference exists between the first point and the second point, said temperature difference being between about 5° C. and about 30° C. during a quench cycle which starts from a first time when the second point about 5° C. above a martensite start temperature of the specific metal or metal alloy and ends at a second time when the first point at a temperature which is about, or below, a martensite finish temperature of the specific metal or metal alloy.

2. The method of claim 1, wherein the step of quenching the hot metal part comprises exposing the hot metal part to a plurality of quench cycles wherein each quench cycle comprises introducing a first amount of a quenchant at a first quenchant temperature for a first quench time into a quench chamber containing the hot metal part, and subsequently introducing at least one subsequent amount of the quenchant at a subsequent quenchant temperature below the first quenchant temperature for a subsequent quench time into the quench chamber.

3. The method of claim 2, wherein the first amount of the quenchant and the at least one subsequent amount of the quenchant are each independently a quenchant selected from the group consisting of air, steam, water mist, and nitrogen.

4. The method of claim 3, wherein the first amount of the quenchant and the at least one subsequent amount of the quenchant are each of the same type of quenchant.

5. The method of claim 3, wherein the first amount of the quenchant and the at least one subsequent amount of the quenchant are each nitrogen.

6. The method of claim 1, conducted according to a cooling schedule obtained prior to quenching the hot metal part using the steps of:

I. determining a CAD geometry of the hot metal part;

II. creating a finite element mesh from the CAD geometry;

III. selecting a heat transfer coefficient;

IV. obtaining a generic cooling schedule for the hot metal part wherein said generic cooling schedule comprises at least a first temperature maintained for a first cooling time, and at least a second temperature maintained for a second cooling time;

V. executing a first finite element analysis from the CAD geometry using the generic cooling schedule, the known heat transfer coefficient, and the inherent metal properties to identify a first node on the finite element mesh which has a hottest temperature and a second node on the finite element mesh which has a coldest temperature; and VI. determining the cooling schedule by iteratively modifying the temperature and time conditions in subsequent finite element analyses so that a temperature difference between the first node and the second node is maintained between about 5° C. and about 30° C. during a solid phase transformation of the first node and the second node from the austenite phase to the martensite phase.

7. The method of claim 6, wherein the CAD geometry is selected from the group consisting of a three dimensional CAD geometry, a two-dimensional CAD geometry, or a one dimensional CAD geometry.

8. The method of claim 6, wherein the second temperature is less than the first temperature.

9. The method of claim 6, further comprising a plurality of subsequent cooling temperatures for use in subsequent quench cycles, wherein in each quench cycle, each subsequent cooling temperature is maintained for a subsequent cooling time, and each subsequent cooling temperature is less than its previous cooling temperature.

10. The method of claim 1, conducted according to an empirically determined quenching schedule comprising the steps of:

I. placing a first temperature measurement device at the first point and a second temperature measurement device at the second point and II. iteratively exposing the hot metal part to a quenchant at various quenchant temperatures and for various times so as to quantify the temperature difference during the quench cycle.

11. The method of claim 1, conducted according to a quenching schedule determined in real time during the quenching step, comprising the steps of:

I. measuring a temperature of the first node using a first temperature measurement device and a second temperature of the second node using a second temperature measurement device while the hot metal part is exposed to a quenchant at a quenchant temperature, and II. adjusting the quenchant temperature to maintain the temperature difference during the quench cycle.

* * * * *